US006964743B2

(12) United States Patent
Min et al.

(10) Patent No.: US 6,964,743 B2
(45) Date of Patent: Nov. 15, 2005

(54) INKJET PRINTHEAD AND MANUFACTURING METHOD THEREOF

(75) Inventors: Jae-sik Min, Gyeonggi-do (KR); Myung-song Jung, Gyeonggi-do (KR); Sung-joon Park, Gyeonggi-do (KR); Seo-hyun Cho, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 191 days.

(21) Appl. No.: 10/388,622

(22) Filed: Mar. 17, 2003

(65) Prior Publication Data

US 2003/0160842 A1 Aug. 28, 2003

Related U.S. Application Data

(62) Division of application No. 10/197,819, filed on Jul. 19, 2002, now Pat. No. 6,595,627.

(30) Foreign Application Priority Data

Nov. 15, 2001 (KR) ..... 2001-71100

(51) Int. Cl.[7] ..... B41J 2/16

(52) U.S. Cl. ..... 216/27; 216/41; 216/67; 347/65; 438/21

(58) Field of Search ..... 216/27, 41, 67; 438/21; 347/65

(56) References Cited

U.S. PATENT DOCUMENTS

| | | | | |
|---|---|---|---|---|
| 4,894,664 | A * | 1/1990 | Tsung Pan | 347/63 |
| 6,019,457 | A | 2/2000 | Silverbrook | 347/65 |
| 6,364,466 | B1 * | 4/2002 | Chen et al. | 347/65 |
| 6,402,301 | B1 * | 6/2002 | Powers et al. | 347/63 |
| 2004/0075722 | A1 * | 4/2004 | Lee et al. | 347/93 |

* cited by examiner

*Primary Examiner*—Shamim Ahmed
(74) *Attorney, Agent, or Firm*—Staas & Halsey LLP

(57) ABSTRACT

An inkjet printhead and a manufacturing method thereof. The inkjet printhead includes a substrate, a substantially cylindrical ink chamber storing ink and formed in an upper portion of the substrate, and a manifold supplying ink to the ink chamber in a bottom portion of the substrate, a channel-forming layer disposed between the ink chamber and the manifold and having an ink channel communicating between the ink chamber and the manifold, a nozzle plate stacked on the substrate and having a nozzle at a location corresponding to the central part of the ink chamber, a heater formed to surround the nozzle of the nozzle plate, and electrodes electrically connected to the heater to supply current to the heater. Therefore, the quantity of ink stored in an ink chamber can be increased. Also, when bubbles grow, the cylindrical ink chamber confines an ink flow area to ink ejectors, thereby reducing a back flow of the ink. Further, the quantity of ink supplied to the ink chamber can be adjusted by varying the number of ink channels formed in the channel-forming layer, thereby improving frequency characteristics of the inkjet printhead.

17 Claims, 10 Drawing Sheets

INKJET PRINTHEAD AND MANUFACTURING METHOD THEREOF

CROSS-REFERENCE TO RELATED APPLICATIONS

This application is a Divisional of application Ser. No. 10/197,819, filed Jul. 19, 2002, U.S. Pat. No. 6,595,627.

This application claims the benefit of Korean Application No. 2001-71100, filed Nov. 15, 2001, in the Korean Industrial Property Office, the disclosure of which is incorporated herein by reference.

BACKGROUND OF THE INVENTION

1. Field of the Invention

The present invention relates to an inkjet printhead and a manufacturing method thereof, and more particularly, to a bubble-jet type inkjet printhead having improved structures of an ink chamber and ink channels, and a manufacturing method thereof.

2. Description of the Related Art

Ink ejection mechanisms of an inkjet printer are largely categorized into two types: an electro-thermal transducer type (bubble-jet type) in which a heat source is employed to form bubbles in ink to eject the ink, and an electro-mechanical transducer type in which ink is ejected by a change in ink volume due to deformation of a piezoelectric element.

According to a bubble growing direction and a droplet ejecting direction, electro-mechanical transducer types are classified into top-shooting, side-shooting, and back-shooting types. In a top-shooting type printhead, bubbles grow in the same direction that ink droplets are ejected. In a side-shooting type printhead, bubbles grow in a direction perpendicular to the direction that ink droplets are ejected. In a back-shooting type printhead, bubbles grow in a direction opposite to a direction in which ink droplets are ejected.

A bubble-jet type inkjet printhead needs to meet the following conditions. First, a simplified manufacturing process, a low manufacturing cost, and mass production must be allowed. Second, in order to produce high quality color images, creation of minute satellite droplets that trail ejected main droplets must be prevented. Third, when ink is ejected from one nozzle or an ink chamber is refilled with ink after the ink ejection, a cross-talk between the nozzle and its adjacent nozzle through ink which is not ejected, must be prevented. To this end, a back flow of ink, that is, a phenomenon that ink flows in an opposite direction to a normal ejection direction, must be avoided during the ink ejection. Fourth, for a high speed printing, a refill cycle after the ink ejection must be as short as possible. That is, an operating frequency must be high.

Considering the above conditions, the performance of an inkjet printhead is closely associated with structures of the ink chamber, ink channels, and a heater, the type of formation and expansion of bubbles, and the relative size of each component.

FIG. 1 is a schematic cross-sectional view of a conventional inkjet printhead disclosed in a U.S. Pat. No. 6,019,457.

Referring to FIG. 1, an ink chamber 15 having a hemispherical shape is formed in an upper portion of a substrate 10 made of silicon, etc., and an ink supply manifold 16 supplying the ink chamber 15 with ink is formed in a lower portion of the substrate 10. An ink channel 13 communicating with the ink chamber 15 and the ink supply manifold 16 is formed between the ink chamber 15 and the ink supply manifold 16.

A nozzle plate 20 having a nozzle 11 through which an ink droplet 16 is ejected, is disposed on a surface of the substrate 10 to form an upper wall of the ink chamber 15. The nozzle plate 20 includes a thermal insulation layer 20*a* and a chemical vapor deposition (CVD) overcoat layer 20*b*.

In the nozzle plate 20, an annular heater 12 surrounding the nozzle 11 is formed in the vicinity of the nozzle 11. The annular heater 12 is located at an interface between the thermal insulation layer 20*a* and the CVD overcoat layer 20*b*. Meanwhile, the heater 12 is connected to an electric line (now shown) through which a current pulse is supplied to the annular heater 12.

In the above-described configuration, in a state that the ink chamber 15 is filled with ink supplied through the manifold 16 and the ink channel 13, if the current pulse is supplied to the annular heater 12, heat generated by the annular heater 12 is transmitted through the underlying thermal insulation layer 20*a*, and the ink under the heater 12 is boiled to form a bubble B. Thereafter, as the heat is continuously generated from the annular heater 12 so that the bubble B expands, a pressure is applied to the ink contained in the ink chamber 15, and the ink around the nozzle 11 is ejected in a form of an ink droplet 18 through the nozzle 11. Then, new ink is introduced through the ink channel 13 to refill the ink chamber 15.

In the conventional inkjet printhead, since the ink chamber 15 has the hemispherical shape and is formed on the substrate 10 by isotropically etching, the degree of accuracy and reproducibility of the inkjet printhead deteriorates when the ink chamber 15 is manufactured. Also, the amount of ink contained in the ink chamber 15 is relatively small in view of a volume of the ink chamber 15. Also, the hemispherical ink chamber 15 is configured such that the ink may be easily ejected to the ink channel 13 in a case where the ink around the annular heater 12 is pushed away by a bubble pressure caused when the bubble B is formed. When the ink is ejected, and when the bubble B is contracted, it is difficult to smoothly refill the ink chamber 15 with the new ink.

Although the ink channel and the nozzle are aligned to make an ink flowing direction substantially linear, a problem occurring in the aforementioned conventional inkjet printhead is that the ink flow is not smooth during the ink ejection. This results in undesirable frequency characteristics of the inkjet printhead.

Since only a single ink channel is formed for each ink chamber, it is difficult to adjust a transferring amount of ink passing through the ink channel. A manufacturing process of such an ink channel is also complicated.

SUMMARY OF THE INVENTION

To solve the above and other problems, it is an object of the present invention to provide a bubble-jet type inkjet printhead having improved structures of an ink chamber and an ink channel to improve an ejection performance.

Additional objects and advantages of the invention will be set forth in part in the description which follows and, in part, will be obvious from the description, or may be learned by practice of the invention.

To accomplish the above and other objects according to an embodiments of the present invention, there is provided an inkjet printhead including a substrate, a substantially cylindrical ink chamber formed in an upper portion of the substrate to store ink to be ejected, a manifold supplying ink to the ink chamber and formed in a bottom portion of the substrate, a channel-forming layer disposed between the ink chamber and the manifold and having an ink channel communicating between the ink chamber and the manifold, a nozzle plate stacked on a top surface of the upper portion of the substrate and having a nozzle at a location corresponding to a central portion of the ink chamber, a heater formed to surround the nozzle of the nozzle plate, and electrodes electrically connected to the heater to supply current to the heater.

Here, the inkjet printhead may include a nozzle guide formed on a periphery of the nozzle to extend toward the ink chamber.

Also, according to an aspect of the present invention, a plurality of ink channels are formed in the ink chamber at equal intervals along a circumference having a predetermined radius.

The channel-forming layer may include a first material layer forming a bottom of the ink chamber. Here, the first material layer is a silicon oxide material layer. The channel-forming layer may further include a second material layer formed on the first material layer as a buffer layer of the first material layer. The second material layer is a polycrystalline silicon layer.

In accordance with another aspect of the present invention, there is provided a method of manufacturing an inkjet printhead. The method includes forming a nozzle plate on the a surface of a substrate, forming a heater on the nozzle plate, forming electrodes electrically connected to the heater on the nozzle plate, forming a nozzle by etching the nozzle plate, forming a manifold by etching the bottom portion of the substrate by a predetermined depth, forming a channel-forming layer on a bottom surface of the etched bottom portion of the substrate, forming a substantially cylindrical ink chamber by etching the substrate exposed through the nozzle, and forming an ink channel communicating between the ink chamber and the manifold in the channel-forming layer.

The forming of the channel forming layer includes forming a first material layer forming the bottom of the ink chamber on the bottom surface of the etched substrate. Here, the first material layer is a silicon oxide material layer deposited by plasma Enhanced Chemical Vapor Deposition (PECVD). The channel-forming layer may include a second material layer formed on the first material layer as a buffer layer of the first material layer. The second material layer is a polycrystalline silicon layer.

The forming of the channel-forming layer may include forming an ink chamber having the substantially cylindrical ink chamber by isotropically etching the substrate exposed through the nozzle using the first material layer as an etch stop layer.

Alternatively, the forming of the ink chamber may include forming a trench by anisotropically etching the substrate exposed through the nozzle, depositing a predetermined material layer over the entire surface of the anisotropically etched substrate by a predetermined thickness, exposing a bottom of the trench by aniostropically etching the predetermined material layer and simultaneously forming a nozzle guide of the predetermined material layer along side walls of the trench, and forming the substantially cylindrical ink chamber by isotropically etching the exposed substrate below the bottom of the trench using the first material layer as an etch stop layer.

The isotropically etching of the substrate includes isotropically dry etching using an $XeF_2$ gas as an etching gas.

Also, the forming of the ink channel may include forming a plurality of ink channels. Here, the ink channels are arranged in the ink chamber at equal intervals along a circumference having a predetermined radius. Also, the ink channel is formed by etching the channel forming layer from the manifold to the ink chamber by RIE (Reactive Ion Etching) or by processing the ink channel-forming layer in a direction from the manifold to the ink chamber by a laser process.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE INVENTION

Figure 1:
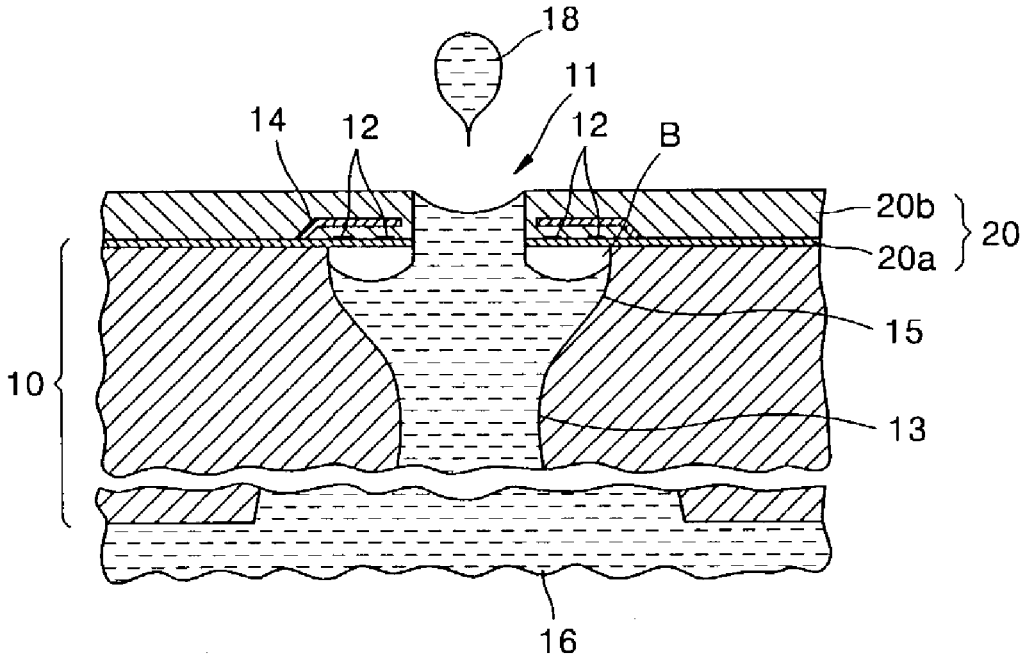
FIG. 1 (PRIOR ART)
FIG. 1 is a cross-sectional view showing a conventional inkjet printhead.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

The present invention will now be described more fully with reference to the accompanying drawings, in which preferred embodiments of the invention are shown. This invention may however, be embodied in many different forms and should not be construed as being limited to the embodiments set forth herein. Rather, these embodiments are provided so that this disclosure will be thorough and complete, and will fully convey the concept of the invention to those skilled in the art. In the drawings, the shape of elements is exaggerated for clarity, and the same reference numerals appearing in different drawings represent the same element. Further, it will be understood that when a layer is referred to as being "on" another layer or substrate, it can be directly on the other layer or substrate, or intervening layers may also be present.

Figure 2:
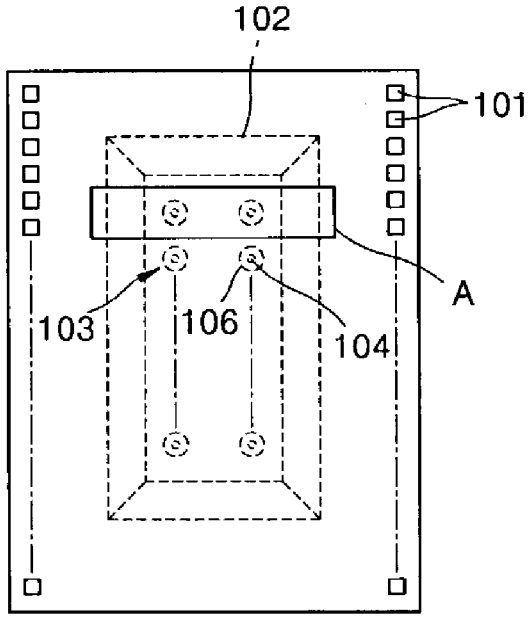
FIG. 2 is a schematic plan view of an inkjet printhead according to an embodiment of the present invention.

FIG. 2 is a schematic plan view of a bubble-jet type inkjet printhead according to an embodiment of the present invention.

Referring to FIG. 2, ink ejectors 103 are arranged in two rows along both sides of an ink supply manifold 102 indicated in a dotted line. Also, there are provided bonding pads 101 which are electrically connected to the respective ink injectors 103 and to which wires are to be bonded. The manifold 102 is connected with an ink container (not shown) containing ink. A nozzle 104 and an ink chamber 106 are formed on respective ink ejectors 103. Although the ink ejectors 103 shown in FIG. 2 are arranged in two rows, they may be arranged in one row. Otherwise, in order to achieve high resolution, they may be arranged in three or more rows.

Figure 3:
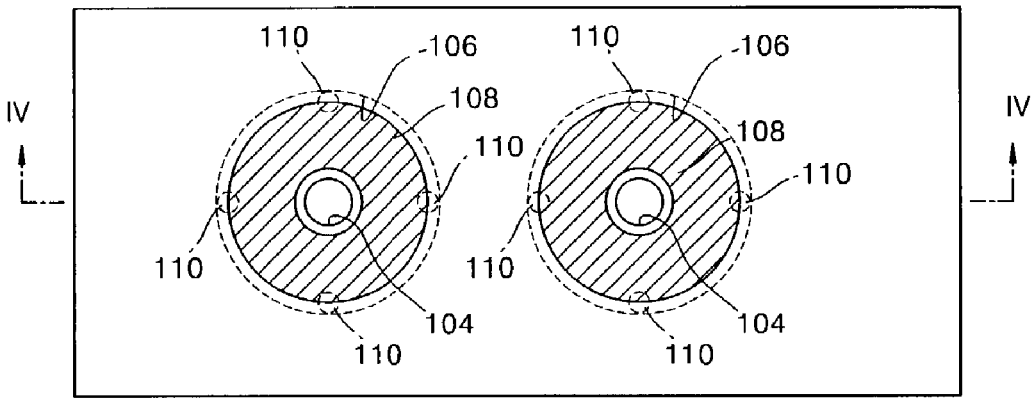
FIG. 3 is an enlarged plan view of a part A of the inkjet printhead shown in FIG. 2.
Figure 4:
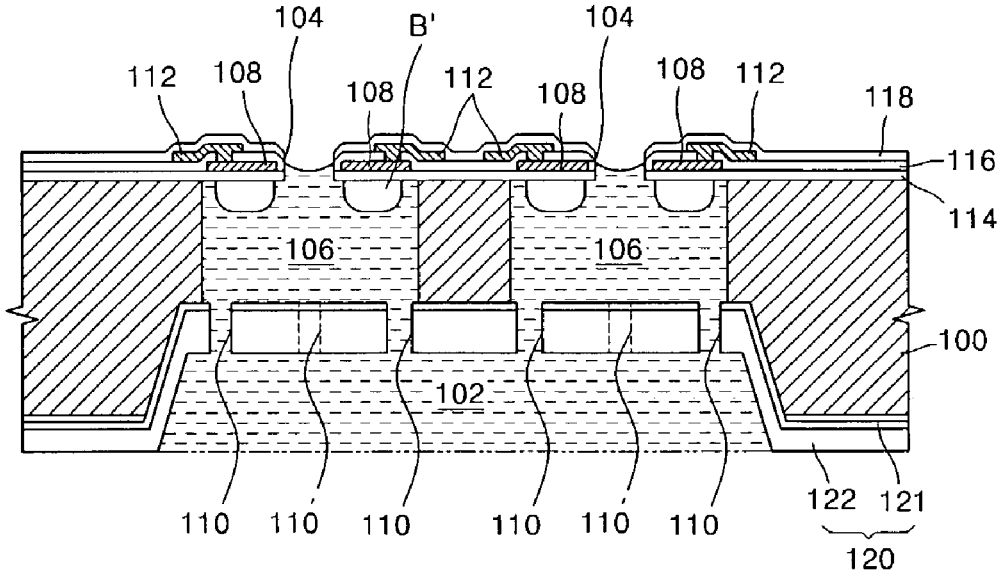
FIG. 4 is a cross-sectional view of the inkjet printhead taken along the line IV—IV shown in FIG. 3.

FIG. 3 is a plan view of a part A of the inkjet printhead as shown in FIG. 2, and FIG. 4 is a cross-sectional view showing a vertical structure of the inkjet printhead taken along the lines IV—IV shown in FIG. 3.

The inkjet printhead will now be described in detail with reference to FIGS. 3 and 4.

First, an ink chamber 106 containing ink has a substantially cylindrical shape and is formed in a top side of a substrate 100, and the ink supply manifold 102 supplying ink to the ink chamber 106 is formed in a bottom side of the substrate 100. Here, the substrate 100 is made of silicon that is widely used in manufacturing integrated circuits.

A channel forming layer 120 having ink channels 110 communicating between the ink chamber 106 and the manifold 102 is formed between the ink chamber 106 and the manifold 102. The channel forming layer 120 includes a first material layer 121 which forms a bottom of the ink chamber 106 and a second material layer 122 stacked on the first material layer 121. The first material layer 121 serves as an etch-stop layer in a course of forming the ink chamber 106 by etching the substrate 100. The ink chamber 106 has a substantially cylindrical shape. In this case, the first material layer 121 is an oxide layer deposited by PECVD (Plasma Enhanced Chemical Vapor Deposition). In particular, if the substrate 100 is made of silicon, the first material layer 121 may be a silicon oxide layer. The second material layer 122 is a buffer layer of the first material layer 121 and serves to maintain the ink channels 110. If the substrate 100 is made of silicon, the second material layer 122 may be a polycrystalline silicon layer. A plurality of ink channels 110 communicating between the ink chamber 120 and the manifold 102 are formed in the channel-forming layer 120. The ink channels 110 are arranged in the ink chamber 106 at equal intervals along a circumference having a predetermined radius. Although FIGS. 3 and 4 show that four ink channels 110 are formed in the channel-forming layer 120, variable numbers of ink channels can be employed in order to control the quantity of ink supplied to the ink chamber 106.

A nozzle plate 114 having a nozzle 104 is formed on the substrate 100 to serve as an upper wall of the ink chamber 106. If the substrate 100 is made of silicon, the nozzle plate 114 may be made of a silicon oxide layer formed by oxidizing a silicon substrate or an insulation layer, such as a silicon nitride layer, deposited on the substrate 100.

A heater 108 having an annular shape and forming a bubble is disposed on the nozzle plate 114 so as to surround the nozzle 104. The heater 108 is a resistive heating element, such as polycrystalline silicon doped with impurities or a tantalum-aluminium alloy, and electrodes 112 are connected to the heater 108 to supply a current to the heater 108. The electrodes 112 are generally made of the same materials as the bonding pads 101 of FIG. 2 and necessary wiring lines (not shown), for example, a metal such as aluminium or an aluminium alloy. In order to protect the heater 108 and the electrodes 112, a heater passivation layer 116 and an electrode passivation layer 118 are formed on the heater 108 and the electrodes 112, respectively.

In the above-described configuration, if the current is supplied to the heater 108 in a state in which the ink chamber 106 is filled with ink supplied through the manifold 102 and the ink channels 110 by a capillary process, heat generated by the heater 108 is transmitted through the nozzle plate 114 to boil the ink disposed under the heater 108 and form bubbles B'. The bubbles B' are substantially annular shaped.

If the bubbles B' expand during a lapse of time, the ink in the ink chamber 106 is ejected through the nozzle 104 by a bubble pressure.

Next, when the current is not supplied to the heater 8, the ink is cooled so that the bubbles B' are shrunk or burst, and then the ink chamber 106 is refilled with ink.

In the above-described inkjet printhead, since the ink chamber 106 is formed in a cylindrical shape, the quantity of ink stored per unit area increases compared to the conventional hemispherical ink chamber. Also, when the bubbles grow, the cylindrical ink chamber 106 confines an ink flow area to the ink ejectors 103, thereby reducing a back flow of ink, that is, a phenomenon that ink in the ink chamber 106 flows out to the ink channels 110 from the ink chamber 106. Thus, ejection characteristics including an ejection speed, a quantity of droplets and the like, can be improved.

Meanwhile, the quantity of ink supplied to the ink chamber 106 can be adjusted by varying the number of ink channels 110 formed in the channel forming layer 120, thereby improving frequency characteristics.

Figure 5:
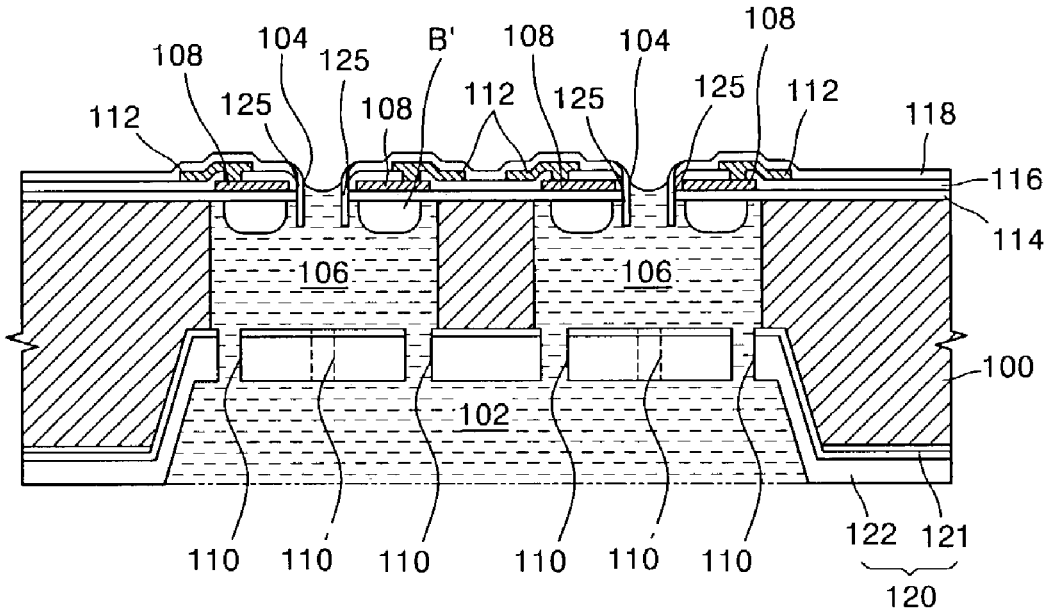
FIG. 5 is a cross-sectional view of an ink jet printhead according to another embodiment of the present invention.

FIG. 5 is a cross-sectional view of an inkjet printhead according to another embodiment of the present invention. This inkjet printhead is different from the inkjet printhead shown in FIG. 4 in that a nozzle guide 125 extends from an edge of the nozzle 104 toward the ink chamber 106. An ejection direction of the ejected droplet is guided by the nozzle guide 120 when the bubbles B' grow, thereby allowing the droplet to be ejected exactly perpendicular to the substrate 100 or the nozzle plate 114.

Hereinafter, a method of manufacturing the inkjet printhead of FIG. 4 will now be described. FIGS. 6 through 14 are cross-sectional views showing a method of manufacturing the inkjet printhead shown in FIG. 4.

Figure 6:
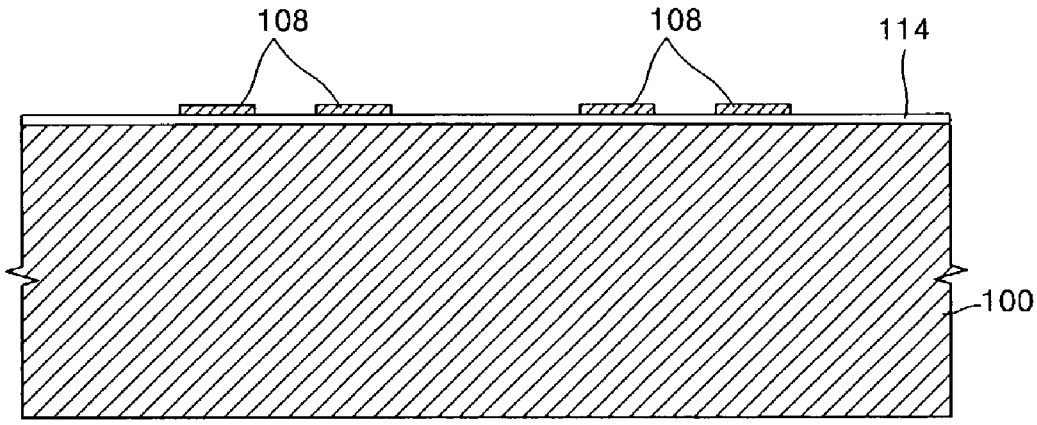
FIGS. 6 through 14 are cross-sectional views showing a process of manufacturing the inkjet printhead shown in FIG. 4.

Referring FIG. 6, the substrate 100 is first formed of a silicon substrate having a thickness of approximately 500 $\mu$m. This is because it is efficient for mass production if a silicon wafer widely used in manufacturing semiconductor devices is used as it is.

Next, the silicon wafer 100 is wet or dry oxidized in an oxidation furnace to form a silicon oxide layer that can be used as the nozzle plate 114, on an upper surface of the substrate 100. A nozzle is to be formed later on the nozzle plate 114.

Although only a small portion of the silicon wafer 100 is shown in FIG. 6, the inkjet printhead may be one of tens or hundreds of chips produced from the single wafer.

Next, the annular heater 108 is formed on the nozzle plate 114. The annular heater 108 is formed by depositing polycrystalline silicon doped with impurities or a tantalum-aluminium alloy over the nozzle plate 114, for example, and patterning the same annular shape of the nozzle 104. In detail, the polycrystalline silicon layer doped with impurities may be formed by low pressure chemical vapor deposition (LPCVD) using a source gas containing phosphorous (P) as impurities, the polycrystalline silicon being deposited on the nozzle plate 114 to a thickness of approximately 0.7 to approximately 1 $\mu$m. In a case where the heater 108 is made of a tantalum-aluminium alloy, a tantalum-aluminium alloy layer may be formed to a thickness of approximately 0.1 to approximately 0.3 $\mu$m by sputtering deposition using the tantalum-aluminium alloy as a target or separately using tantalum and aluminium as targets. The thickness to which the polycrystalline silicon layer or the tantalum-aluminium alloy layer may be deposited can be in different ranges so that the heater 108 may have an appropriate resistance in consideration of its width and length. Next, the polycrystalline silicon layer or the tantalum-aluminium alloy layer is patterned by photolithography using a photo mask and a photo resist and by an etching process of etching the polycrystalline silicon layer or the tantalum-aluminium alloy layer deposited over the nozzle plate 114 using a photoresist pattern as an etch mask.

Figure 7:
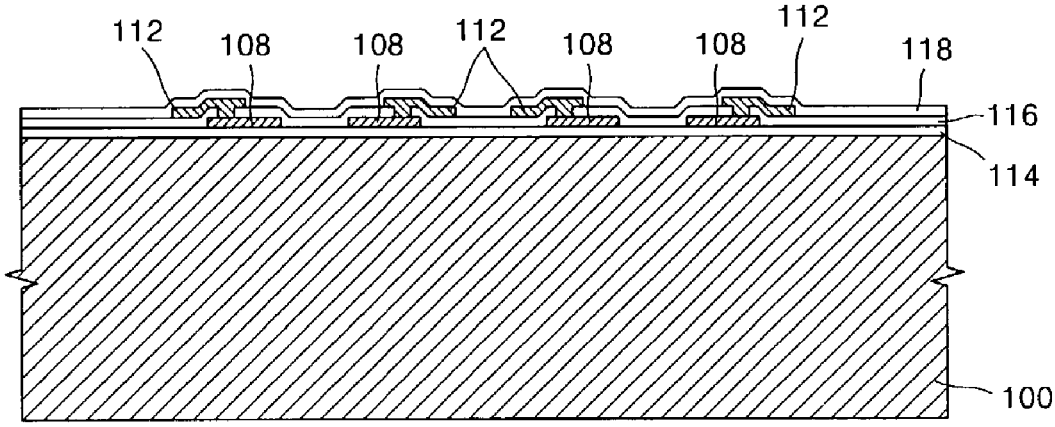

FIG. 7 shows a state in which the heater passivation layer 116 passivating the heater 108 is deposited over the heater 108 and the nozzle plate 114 shown in FIG. 6. After the electrodes 112 are then formed the electrode passivation layer 118 passivating the electrodes 112 is finally deposited thereon.

In detail, the heater passivation layer 116, e.g., a silicon nitride layer, is deposited to a thickness of approximately 0.5 μm by LPCVD, followed by etching the heater passivation layer 116 stacked on the heater 108 and by exposing the heater 108 to be connected with the electrodes 112. Subsequently, the electrodes 112 are formed by depositing a metal having a good conductivity and patterning capability, such as aluminium or an aluminium alloy, to a thickness of approximately 1 μm, and by patterning the metal. In this case, metal layers forming the electrodes 112 are simultaneously patterned so as to form wiring lines (not shown) and the bonding pads 101 of FIG. 2 in other portions of the substrate 100. Next, a TEOS (Tetraethylorthosilane) oxide layer is deposited over the substrate 100 on which the electrodes 112 are to be formed. The TEOS oxide layer, that is, the electrode passivation layer 118, is formed to a thickness of approximately 1 μm by CVD, at low temperature at which the electrodes 112 and the bonding pads made of aluminium or an aluminium alloy are not deformed, for example, at lower than about 400°.

Figure 8:
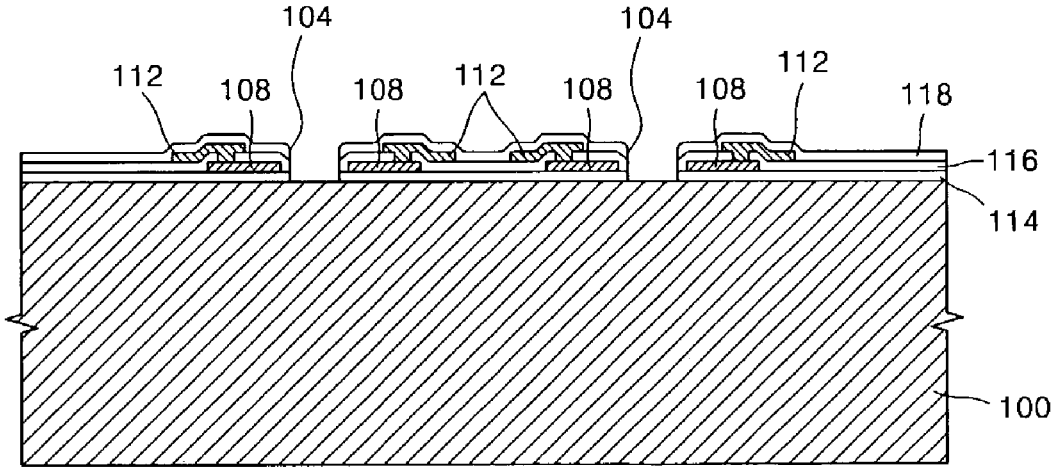

FIG. 8 shows a state in which the nozzle is formed on a resultant structure shown in FIG. 7. In detail, the electrode passivation layer 118, the heater passivation layer 116 and the nozzle plate 114 are sequentially etched to expose a potential nozzle portion of the substrate 100 to have a diameter smaller than that of the heater 108.

Figure 9:
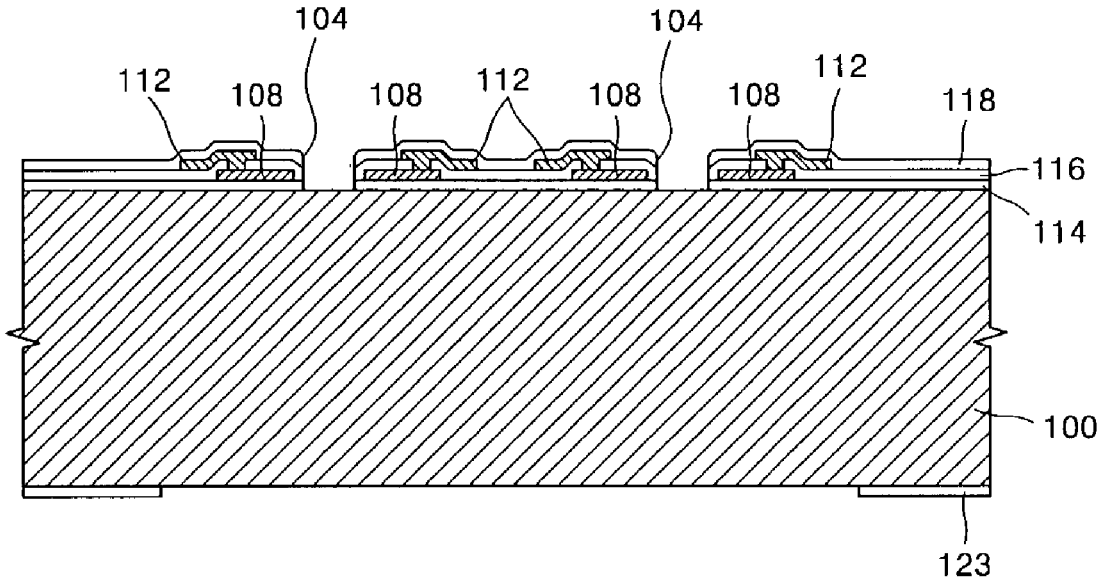
Figure 10:
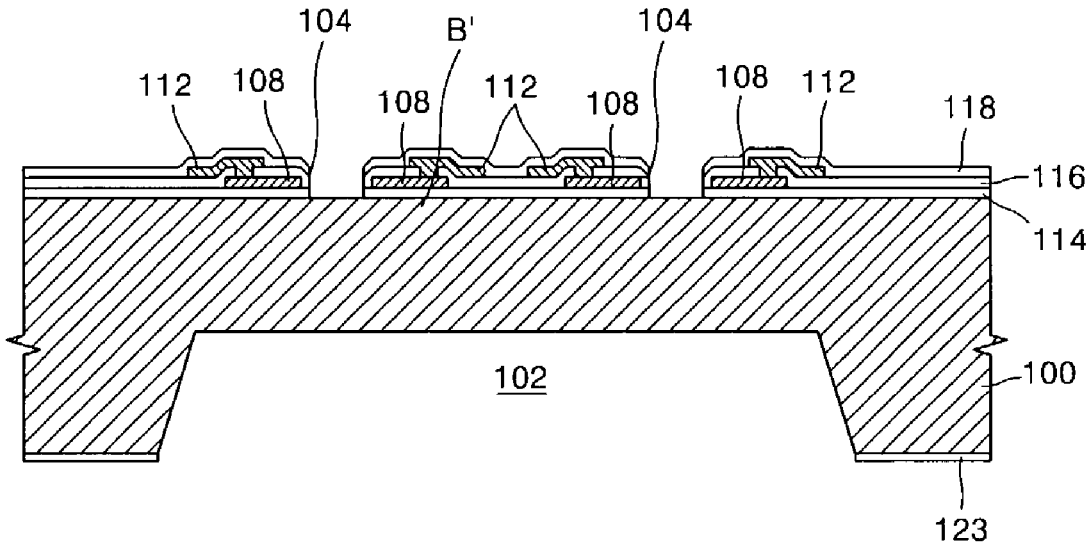

FIGS. 9 and 10 show forming the manifold 102 by tilt-etching a bottom portion of the substrate 100. In detail, a silicon oxide layer having a thickness of approximately 1 μm is deposited on a portion of a bottom surface of the substrate 100 and patterned, thereby forming an etch mask 123 that limits a region to be etched. Next, an area of the substrate 100 other than that of the etch mask 123 is wet etched to have a thickness of approximately 30 to approximately 40 μm for a predetermined period of time using tetramethyl ammonium hydroxide (TMAH) as an etchant, or is dry etched by ICP-RIE (Inductively Coupled Plasma-Reactive Ion Etching), thereby forming the manifold 102 on the bottom surface of the portion 100.

Alternatively, the manifold 102 may be formed by etching the substrate 100 prior to the formation of the nozzle 104 shown in FIG. 8. Also, the manifold 102 may be formed by anisotropically etching rather than by the tilt-etching that has been described above.

Figure 11:
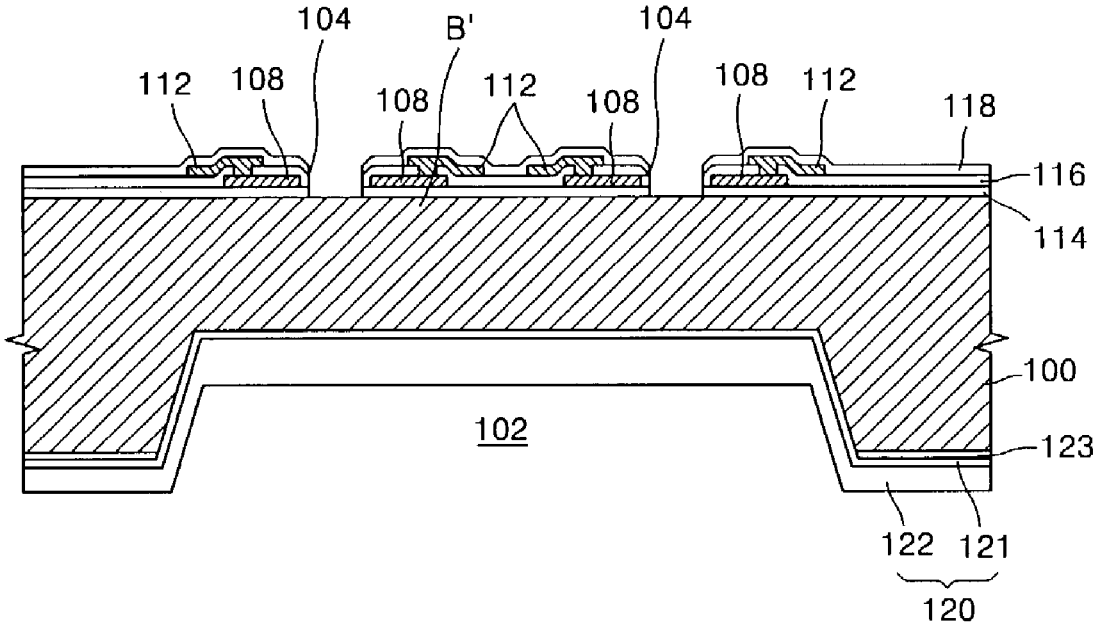

FIG. 11 shows a state in which the channel-forming layer 120 is formed on the etch mask 123 and an etched bottom surface of the substrate 100 shown in FIG. 10. The channel-forming layer 120 includes the first material layer 121 and the second material layer 122 sequentially stacked on the etch mask 123 and the etched bottom surface of the substrate 100. In detail, the first material layer 121 is formed on the bottom surface of the etched substrate 100 forming a lower bottom of the ink chamber 106 to be described later. Here, the first material layer 121 is a silicon oxide material layer having a thickness of approximately 1 μm and deposited by, for example, PECVD (Plasma Enhanced Chemical Vapor Deposition), and serves as an etch stop layer during formation of the cylindrical ink chamber 106. Next, the second material layer 122 is formed on the first material layer 121. The second material layer 122 is a polycrystalline silicon layer having a thickness of approximately 10□ and deposited on the first material layer 121 and serves as a buffer layer of the first material layer 121 to maintain the ink channels 110 formed in the channel forming layer 120.

Figure 12:
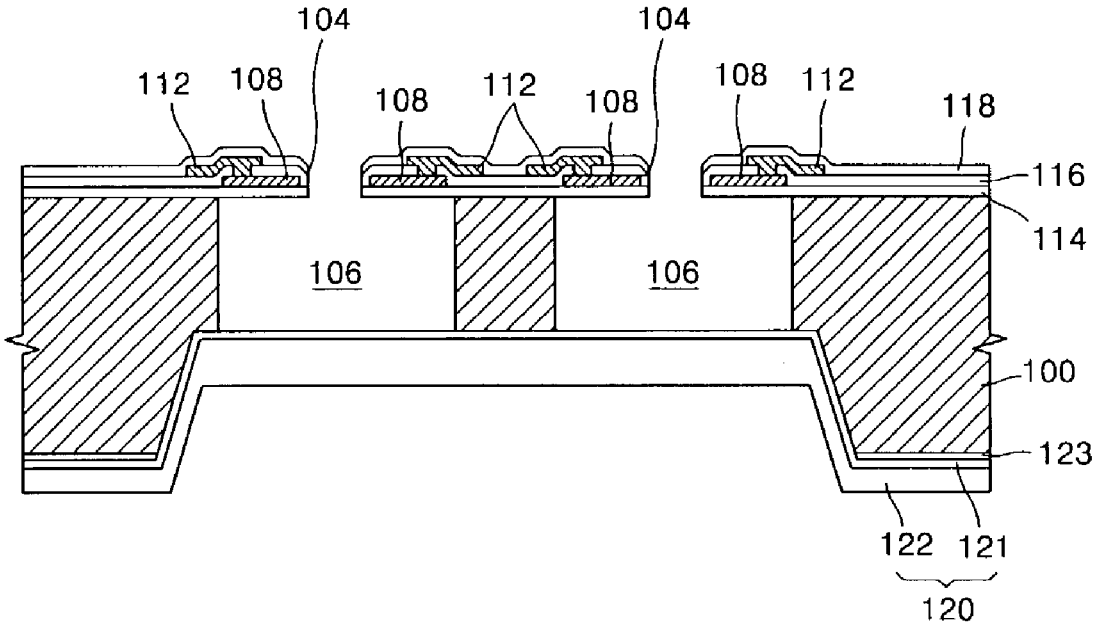

FIG. 12 shows a state in which the cylindrical ink chamber 106 is formed by etching the substrate exposed through the nozzle 104. That is, the ink chamber 106 may be formed by isotropically etching the substrate 100 exposed through the nozzle 104 in a substantially cylindrical shape. In detail, the ink chamber 106 may be formed by dry etching the substrate 100 made of silicon, using an $XeF_2$ gas as an etch gas. In this case, the first material layer 121, such as a silicon oxide material layer, serves as the etch stop layer of the substrate 100. As an etching process proceeds, the substantially cylindrical ink chamber 106 is formed as shown in FIG. 12.

Figure 13:
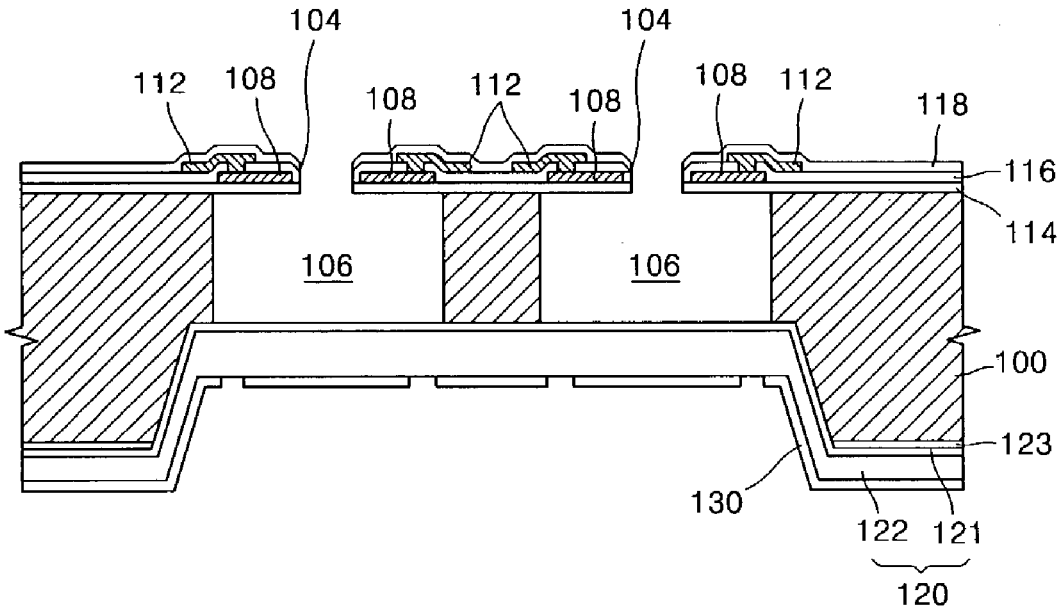
Figure 14:
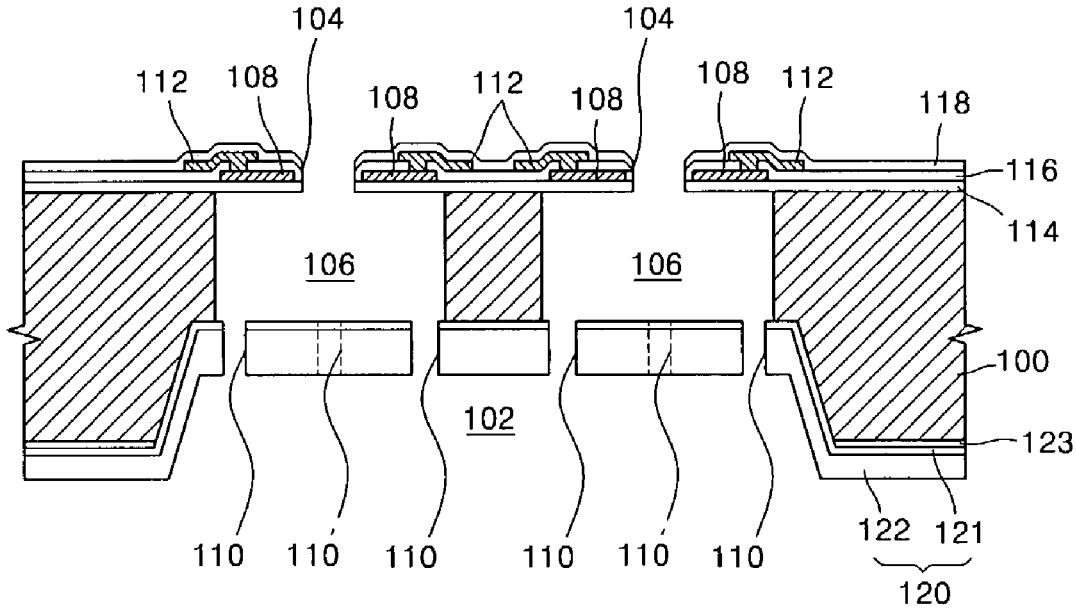

FIGS. 13 and 14 show forming the ink channels 110 by etching the channel-forming layer 120. In detail, a photoresist is applied over a bottom surface of the channel forming layer 120 by, for example, spray coating, and patterned to form a photoresist pattern having a thickness of approximately 1 to approximately 2 μm. The photoresist pattern 130 is formed to expose a portion of the channel-forming layer 120 corresponding to the ink channels 110. Next, the ink channels 110 are formed by etching the exposed portions of the channel forming layer 120 by RIE (Reactive Ion Etching). Alternatively, the ink channels 110 may be formed by processing the channel forming layer 120 using a laser. Although four ink channels 110 are formed and arranged at equal intervals along a circumference having a predetermined radius, the number of the ink channels 110 may vary in order to control the quantity of ink supplied to the ink chamber 106.

As described above, since an ink chamber formed in a substrate has a constant depth, the ink chamber is easily formed. Also, the ink channels are formed by etching the channel-forming layer from the bottom surface of the substrate to the top surface thereof, unlike the conventional technique by which the substrate is etched from its top surface to its bottom surface. Thus, damage occurring in a passivation layer can be fundamentally avoided.

FIG. 15 through FIG. 19 are cross-sectional views showing a process of manufacturing the inkjet printhead shown in FIG. 5.

A method of manufacturing the inkjet printhead shown in FIG. 5 is the same as that of manufacturing the inkjet printhead shown in FIG. 4, except that the forming of a nozzle guide is further provided. That is, the forming of the nozzle guide is further added, following the operations previously described with reference to FIGS. 6 through 11. The operations shown in FIGS. 6 through 11 are applied to both cases of manufacturing the inkjet printheads shown in FIGS. 4 and 5. The manufacturing method of the inkjet printhead having ink ejectors shown in FIG. 5 will now be described in conjunction with a different operation, that is, a nozzle guide formation operation.

Figure 15:
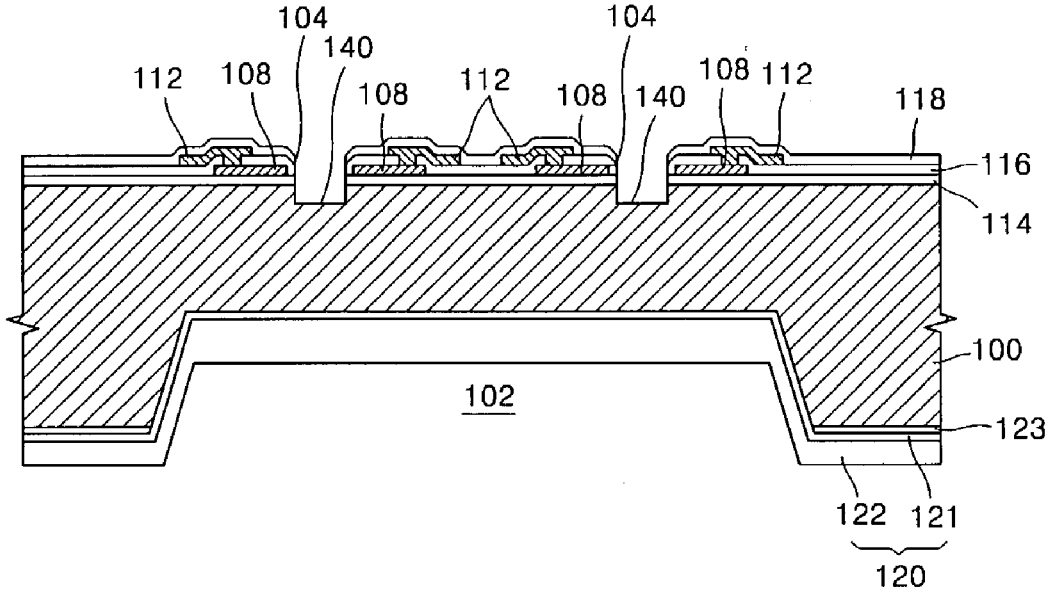
FIGS. 15 through 19 are cross-sectional views showing a process of manufacturing the inkjet printhead shown in FIG. 5.
Figure 16:
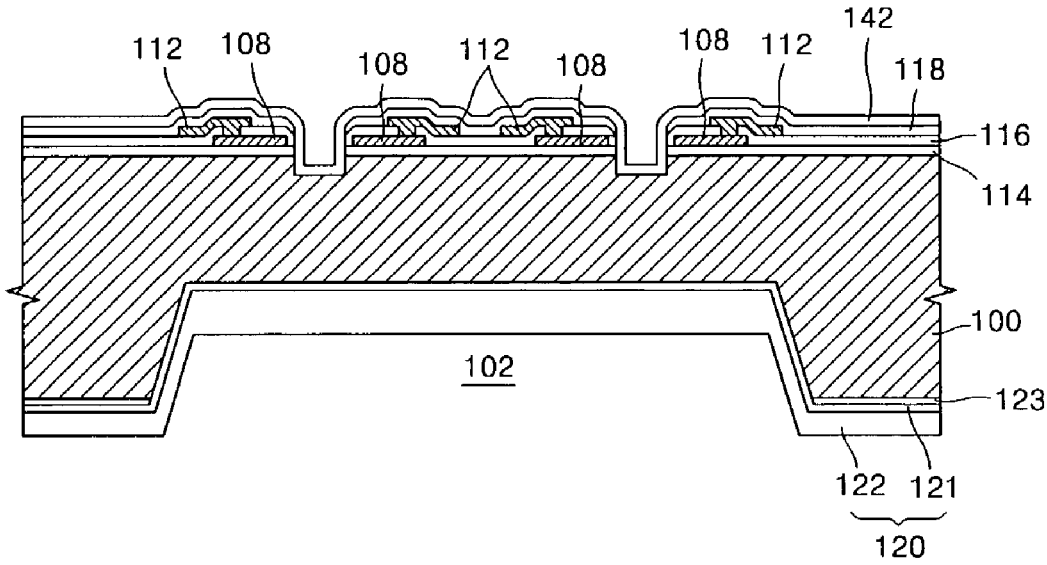

As shown in FIG. 15, a portion of the substrate 100 exposed through the nozzle 104 is aniostropically etched to form a trench 140 having a predetermined depth on a resultant structure shown in FIG. 11. As shown in FIG. 16, a predetermined material layer 142, e.g., a TEOS oxide layer, is deposited to a thickness of approximately 1 □. Next, the material layer 142 is anisotropically etched to expose the substrate 100, forming a nozzle guide 125 along the sidewalls of the trench 140, as shown in FIG. 17.

Figure 17:
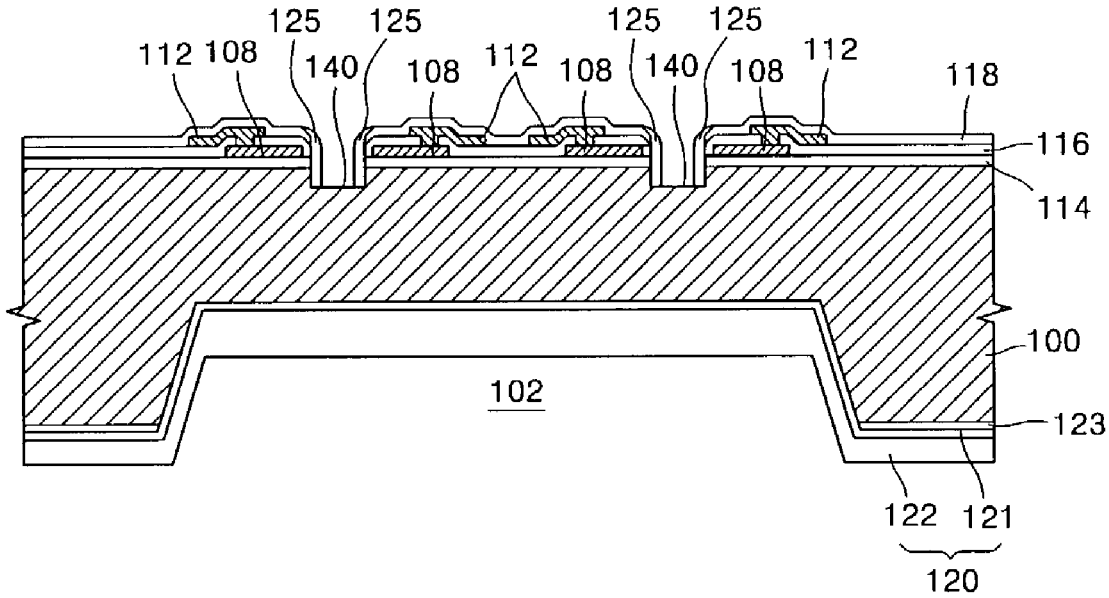
Figure 18:
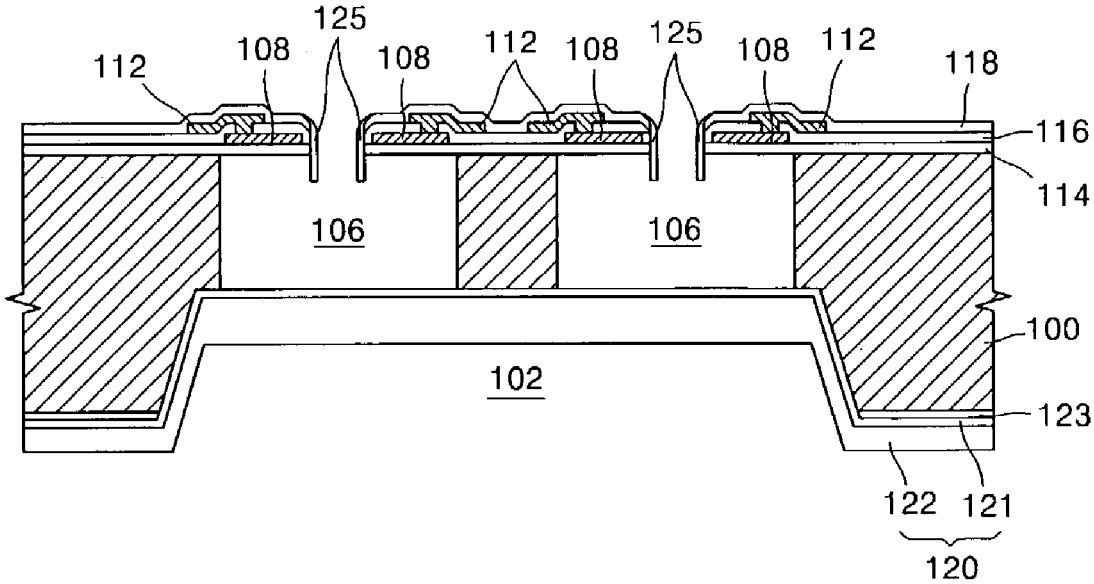
Figure 19:
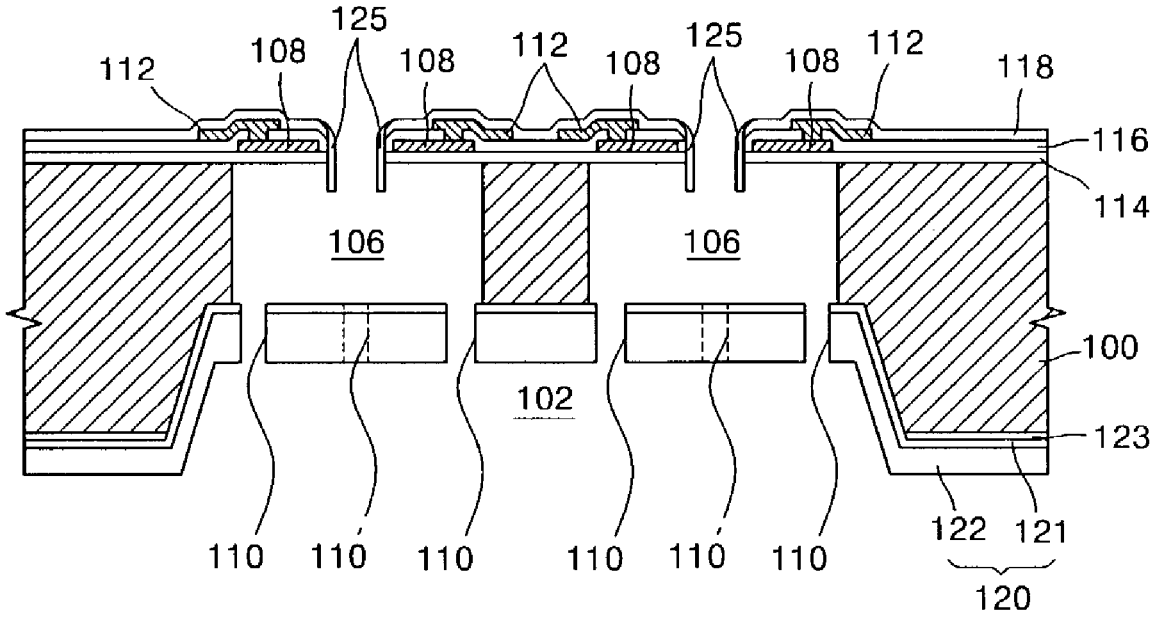

Next, the substrate 100 exposed by the nozzle 104 is isotropically etched on a resultant structure shown in FIG. 17 by the same method as described above, to form the cylindrical ink chamber 106, as shown in FIG. 18. Then, the channel-forming layer 120 is etched or processed using the laser by the same method as shown in FIG. 13, thereby forming the plurality of ink channels 110 as shown in FIG. 19.

Although this invention has been described with reference to a few embodiments thereof, it will be understood by those skilled in the art that various changes in form and details may be made therein. That is to say, materials used in forming various elements of the printhead according to this invention are not limited to illustrated ones. For example, the substrate may be formed of a material, which has a good processibility other than silicon, and the same is also true to a heater, electrodes, a silicon oxide layer or a nitride layer. Furthermore, methods of stacking and forming various material layers are illustrated by way of examples only, and thus a variety of deposition and etching techniques may be adopted.

Also, the sequence of processes in a method of manufacturing a printhead according to this invention may differ, and specific numeric values illustrated in each step may be adjustable within a range in which the manufactured printhead can operate normally.

As described above, according to this invention, the quantity of ink stored in an ink chamber can be increased, by forming the ink chamber in a cylindrical shape, compared to the conventional hemispherical ink chamber. Also, when the bubbles grow, the cylindrical ink chamber confines the ink flow area to ink ejectors, thereby reducing a back flow of ink, that is, a phenomenon that ink in the ink chamber flows out to the ink channels. Thus, ejection characteristics including an ejection speed, a quantity of droplets and the like, can be improved.

Further, the quantity of ink supplied to an ink chamber can be adjusted by varying the number of ink channels formed in a channel-forming layer, thereby improving frequency characteristics.

According to the manufacturing method of the inkjet printhead of the present invention, since the ink chamber formed in the substrate has a constant depth, the ink chamber can be easily manufactured. Also, the ink channels are formed by etching a channel-forming layer from the bottom surface of the substrate to the top surface thereof, unlike the conventional technique by which the substrate is etched from its top surface to its bottom surface. Thus, damage to a passivation layer can be fundamentally avoided.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of manufacturing an inkjet printhead, comprising:

forming a nozzle plate on a top surface of a top portion of a substrate;

forming a heater on the nozzle plate;

forming electrodes electrically connected to a heater on the nozzle plate;

forming a nozzle by etching the nozzle plate;

forming a manifold by etching a bottom portion of the substrate to a predetermined depth, and forming a channel-forming layer on a bottom surface of the etched bottom portion of the substrate;

forming a substantially cylindrical ink chamber by etching the substrate exposed through the nozzle; and forming an ink channel in the channel-forming layer to communicate between the ink chamber and the manifold.

2. The method of claim 1, wherein the forming of the channel forming layer comprises forming a first material layer on the etched bottom surface of the substrate to form a bottom of the ink chamber.

3. The method of claim 2, wherein the forming of the first material layer comprises forming a silicon oxide layer by depositing silicon oxide on the etched bottom surface of the substrate by PECVD (Plasma Enhanced Chemical Vapor Deposition).

4. The method of claim 2, wherein the forming of the substantially cylindrical ink chamber comprises isotropically etching the top portion of the substrate exposed through the nozzle using the first material layer as an etch stop layer.

5. The method of claim 2, wherein the forming of the substantially cylindrical ink chamber comprises:

forming a trench by anisotropically etching the top portion of the substrate exposed through the nozzle;

depositing a material layer over the entire surface of the anisotropically etched top portion of the substrate to a predetermined thickness;

exposing a bottom of the trench by aniostropically etching the material layer and simultaneously forming a nozzle guide of the material layer along a side wall of the trench; and forming the substantially cylindrical ink chamber by isotropically etching the exposed substrate through the bottom of the trench using the first material layer as an etch stop layer.

6. The method of claim 4, wherein the isotropically etching of the substrate comprises isotropically dry etching using a $XeF_2$ gas as an etching gas.

7. The method of claim 2, wherein the forming of the channel-forming layer comprises forming a second material layer on the first material layer opposite to the ink chamber as a buffer layer of the first material layer.

8. The method of claim 7, wherein the forming of the second material layer comprises forming a polycrystalline silicon layer by depositing polycrystalline silicon on the first material layer.

9. The method of claim 7, wherein the forming of the substantially cylindrical ink chamber comprises:

forming a trench by anisotropically etching the top portion of the substrate exposed through the nozzle;

depositing a material layer over the entire surface of the anisotropically etched top portion of the substrate to a predetermined thickness;

exposing a bottom of the trench by aniostropically etching the predetermined material layer and simultaneously forming a nozzle guide of the predetermined material layer along a side wall of the trench; and forming the substantially cylindrical ink chamber by isotropically etching the exposed substrate through the bottom of the trench using the first material layer as an etch stop layer.

10. The method of claim 7, wherein the forming of the substantially cylindrical ink chamber comprises isotropically etching the substrate exposed through the nozzle using the first material layer as an etch stop layer.

11. The method of claim 10, wherein the isotropically etching of the substrate comprises isotropically dry etching using an $XeF_2$ gas as an etching gas.

12. The method of claim 1, wherein the forming of the ink channel comprises etching the channel forming layer from the manifold to the ink chamber by RIE (Reactive Ion Etching).

13. The method of claim 1, wherein the forming of the ink channel comprises processing the ink channel-forming layer in a direction from the manifold to the ink chamber by laser processing.

14. The method of claim 1, wherein the forming of the substantially cylindrical ink channel comprises forming a plurality of ink channels.

15. The method of claim 14, wherein the ink channels are arranged in the ink chamber at equal intervals along a circumference having a predetermined radius.

16. The method of claim 14, wherein the forming of the ink channels comprises etching the channel-forming layer from the manifold to the ink chamber by RIE (Reactive Ion Etching).

17. The method of claim 14, wherein the forming of the ink channels comprises processing the ink channel-forming layer in a direction from the manifold to the ink chamber by a laser processing.

* * * * *